US008485352B1

(12) United States Patent
Hawtof

(10) Patent No.: US 8,485,352 B1
(45) Date of Patent: Jul. 16, 2013

(54) YAD INCLUDING MEZUZAH CASEMENT

(76) Inventor: Daniel W. Hawtof, Corning, NY (US)

( * ) Notice: Subject to any disclaimer, the term of this patent is extended or adjusted under 35 U.S.C. 154(b) by 0 days.

(21) Appl. No.: 13/356,747

(22) Filed: Jan. 24, 2012

(51) Int. Cl.
*A45C 11/00* (2006.01)

(52) U.S. Cl.
USPC ..... 206/19; 206/232

(58) Field of Classification Search
USPC ..... 206/19, 232; D99/25
See application file for complete search history.

(56) References Cited

U.S. PATENT DOCUMENTS

| | | | | |
|---|---|---|---|---|
| 6,006,900 | A * | 12/1999 | Hasten | 206/19 |
| 6,702,107 | B1 * | 3/2004 | Raz | 206/19 |
| 8,269,621 | B2 * | 9/2012 | Shapira et al. | 340/517 |
| 2010/0044248 | A1 * | 2/2010 | Koby et al. | 206/19 |

FOREIGN PATENT DOCUMENTS

FR 2689672 A1 * 10/1993

OTHER PUBLICATIONS http://www.minata.com/judaica/yadmezuzah.
http://stainedglassdesigns.net/judaicthemes/yad.

* cited by examiner

*Primary Examiner* — Bryon Gehman
(74) *Attorney, Agent, or Firm* — William Greener; Alek P. Szecsy; Bond, Schoeneck & King, PLLC

(57) ABSTRACT

A yad-mezuzah casement includes a yad, at least a portion of which serves as a mezuzah casement. A mezuzah may be contained within the mezuzah casement. The mezuzah casement may be contained within the yad, attached to an outer surface of the yad or interposed between the yad and a bracket that includes an attachment fixture used for mounting the yad-mezuzah casement to a doorpost of a building or a room. The yad-mezuzah casement, which itself includes no attachment fixture, provides an opportunity for continuous display of a yad that may be received by a Jewish youth participant at a B'nai Mitzvah ceremony. Together, the yad-mezuzah casement and the mounting bracket provide a yad-mezuzah casement kit.

16 Claims, 5 Drawing Sheets

YAD INCLUDING MEZUZAH CASEMENT

BACKGROUND

1. Field of the Invention

Embodiments relate generally to religious, cultural and functional objects and apparatuses. More particularly, embodiments relate to Judaic religious, cultural and functional objects and apparatuses.

2. Description of the Related Art

Many of the world's most prevalent religions include rites of passage type ceremonies that are often age based, and that often relate to mastery of particular religious subject matter and religious teachings. Confirmation ceremonies are generally representative of such religious rites of passage ceremonies within Christian religions. Within the context of Judaism, such religious rites of passage ceremonies are known as Bar Mitzvah ceremonies for male youth and Bat Mitzvah ceremonies for female youth, which in an aggregate are also often referred to as gender inclusive B'nai Mitzvah ceremonies.

Such religious rites of passage ceremonies often include a commemorative article that is intended to recognize the religious accomplishment or the religious achievement, and the religious ceremony, and to remind the recipient of the commemorative article of the religious importance of the accomplishment, the achievement and the ceremony.

While such religious rites of passage ceremonies are clearly important within modern religious and philosophical belief systems, such religious rites of passage ceremonies are clearly not entirely without problems. In that regard, such religious rites of passage ceremonies are often forgotten in spite of the commemorative article that may be received by a youth participant in a religious rites of passage ceremony.

Thus, desirable within a religious and cultural tradition setting, and in particular within a Judaic religious and cultural tradition setting, are commemorative objects that are more likely to remind the recipient of the religious and cultural traditions.

SUMMARY

Embodiments include a yad including a mezuzah casement (i.e., a yad-mezuzah casement), and a yad-mezuzah casement kit which comprises an assemblage of the yad-mezuzah casement with a particular mounting bracket.

Within the context of the embodiments, a yad comprises a pointer that is used as an aid for reading sacred writings, typically from sacred scrolls. Sacred scrolls are often inscribed with particular passages from sacred writings such as Torah writings or Biblical writings.

Thus, a yad-mezuzah casement in accordance with the embodiments incorporates a yad, which may be a traditional commemorative object from a Bar Mitzvah ceremony or a Bat Mitzvah ceremony (i.e., collectively a gender inclusive B'nai Mitzvah ceremony), with a mezuzah casement that is a common religious ornament that may be attached to a doorpost of a building or a room, such as but not limited to a residential dwelling building or a residential room.

A yad-mezuzah casement in accordance with the embodiments may also include a mezuzah, which is intended as a sacred parchment (i.e., typically a sacred scroll) containing sacred writings. Finally, the embodiments also contemplate a mounting fixture or a mounting bracket that may be used for mounting a yad-mezuzah casement to the doorpost of the building or the room, such as but not limited to the residential dwelling building or the residential room. Such a mounting fixture or a mounting bracket is intended to affix the yad-mezuzah casement to the door post of the building or the room absent any compromise of the functionality of the yad or the mezuzah casement component portions of the yad-mezuzah casement. Moreover, under certain circumstances, the mounting fixture or the mounting bracket may provide a part of the mezuzah casement in accordance with the embodiments. Within the context of the embodiments, the yad-mezuzah casement and the related mounting bracket provide a yad-mezuzah casement kit.

A yad-mezuzah casement in accordance with the embodiments includes a yad component including a shaft component terminating at one end with a pointer. The yad-mezuzah casement in accordance with the embodiments also includes a mezuzah casement component that includes at least a portion of the yad component, absent attachment means for attaching the yad-mezuzah casement to a doorpost.

A yad-mezuzah casement kit in accordance with the embodiments includes a yad-mezuzah casement comprising: (1) a yad component including a shaft component terminating at one end with a pointer; and (2) a mezuzah casement component that includes at least a portion of the yad component, absent attachment means for attaching the yad-mezuzah casement to a doorpost. The yad-mezuzah casement kit in accordance with the embodiments also includes a mounting bracket including attachment means for attaching the yad-mezuzah casement to the doorpost, wherein the attachment means position the yad-mezuzah casement linearly with respect to a baseplate of the mounting bracket.

Another yad-mezuzah casement kit in accordance with the embodiments includes a yad-mezuzah casement comprising: (1) a yad component including a shaft component terminating at one end with a pointer; and (2) a mezuzah casement component that includes at least a portion of the yad component, absent attachment means for attaching the yad-mezuzah casement to a doorpost. This other yad-mezuzah casement kit in accordance with the embodiments also includes a mounting bracket including attachment means for attaching the yad-mezuzah casement to the doorpost, wherein the attachment means position the yad-mezuzah casement offset with respect to a baseplate of the mounting bracket.

BRIEF DESCRIPTION OF THE DRAWINGS

The objects, features and advantages of the embodiments are understood within the context of the Detailed Description of the Embodiments, as set forth below. The Detailed Description of the Embodiments is understood within the context of the accompanying drawings, which form a material part of this disclosure, wherein.

DETAILED DESCRIPTION OF THE EMBODIMENTS

Non-limiting embodiments provide a yad-mezuzah casement, and a yad-mezuzah casement kit that includes an assemblage of a yad-mezuzah casement and a mounting bracket for the yad-mezuzah casement. A yad-mezuzah casement in accordance with the embodiments integrates a yad, which is a religious object that is used as a pointer to assist in reading sacred writings on sacred scrolls without touching the sacred scrolls, with a mezuzah casement that is intended to encase a mezuzah in the form of a sacred scroll containing sacred writings that may be read with the assistance of a yad within a yad-mezuzah casement in accordance with the embodiments.

As is indicated above, a yad in accordance with the embodiments is a pointer that may be used to assist in reading sacred writings from sacred scrolls, such as but not limited to Torah scrolls and Biblical scrolls. A yad in accordance with the embodiments is used since it is customary not to touch a sacred scroll with one's hand or finger. The yad may thus be used to keep one's place in the Hebrew text that is written on a Torah scroll. Yad's are traditionally part of the decoration that is provided for Torahs held in Jewish worship sanctuaries. A yad typically hangs from a cord or chain, often a silver chain, from the handles that are part of the Torah Scrolls. The yad is typically tipped with a hand and/or finger that points to the text.

Figure 1:
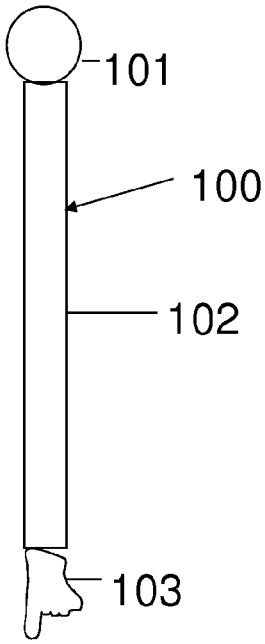
Prior Art Fig. 1
FIG. 1 shows a schematic diagram of a typical yad in accordance with the prior art.

For reference purposes, FIG. 1 shows a yad 100 generally in accordance with the prior art. As is illustrated within FIG. 1, such a yad 100 includes a handle shaft portion 102 capped at a first end portion with an ornamental cap 101 that is optional, and capped at a second end portion opposite the first end portion with a pointer 103 which is fashioned in the likeness of a hand that includes a pointed finger. In practical use, one grasps the yad 100 at the handle shaft portion 102 and uses the pointer 103 as a placemark to guide reading from a sacred scroll or parchment.

It is generally a tradition to provide Bar Mitzvah and Bat Mitzvah youths with their own yads, to use in their B'nai Mitzvah ceremonies. These yads may be fashioned in a variety of artistic styles and made from many materials, such as but not limited to silver, gold, glass, wood, ceramic and the like. Reading from the Torah, for most who participate in Jewish traditions, is a once in the lifetime event that takes place during a B'nai Mitzvah ceremony. The learning and effort to read from the Torah is substantial and is often the pinnacle of a Jewish education and ceremony. Unfortunately, subsequent to a B'nai Mitzvah ceremony an individual's yad may often find its way into a drawer, or onto a mantle, or in a case, often never to be of significance again.

Mezuzahs are parchments or scrolls of Hebrew writing. For example, the Webster dictionary definition of a mezuzah is a small parchment scroll inscribed with Deuteronomy 6:4-9 and 11:13-21, and the name Shaddai, and placed in a case (i.e., a mezuzah casement) fixed to the doorpost by some Jewish families as a sign and reminder of their Jewish faith. In addition, a mezuzah may also be intended to represent such a parchment or scroll and its case, although within the context of the embodiments and as described above, the embodiments use the terminology "mezuzah" for a particular parchment or scroll, and the terminology "mezuzah casement" for the case into which a mezuzah may be located. The foregoing writing from Deuteronomy may be referenced hereafter as "2 paragraphs from the Torah."

A mezuzah casement is often decorated, often at least with an abbreviation of "Shaddai," but alternatively a mezuzah casement may be a simple case or a simple enclosure. A mezuzah casement is provided with a mounting means to mount the mezuzah casement to the doorpost of a building or a room. Within the context of such a doorpost mounting, it is traditional to mount the mezuzah casement such that the top of the mezuzah casement (and thus also a mezuzah placed in the mezuzah casement) is pointing inwards to the house or room and that the top of the mezuzah casement be angled in to the doorway or room by about 5-20 degrees from vertical. Two holes for screw mounting or nail mounting are typically the means of mounting for a mezuzah casement to a doorpost of a building of a room. Such a mezuzah casement is mounted by many of Jewish faith on exterior and interior doorposts of Jewish homes. It is traditional for those of Jewish faith to touch a mezuzah within the mezuzah casement with their fingers upon entering through the doorway and to then put their fingers to their lips. The custom is easy and often is practiced throughout a Jewish person's life.

Figure 2:
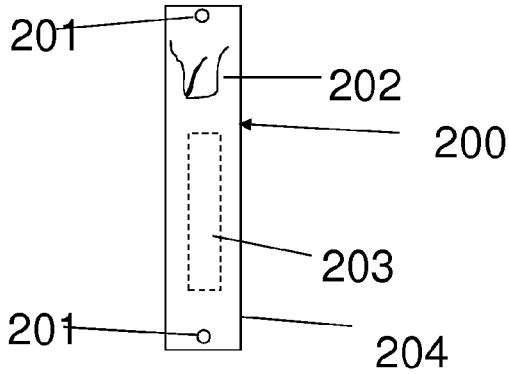
Prior Art Fig. 2
FIG. 2 shows a schematic diagram of a typical mezuzah casement in accordance with the prior art.
Figure 3:
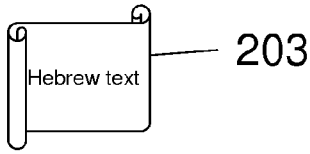
Prior Art Fig. 3
FIG. 3 shows a schematic diagram of a typical mezuzah in accordance with the prior art in the format of a scroll.

For reference purposes a mezuzah casement of the prior art is illustrated in FIG. 2. FIG. 2 shows the mezuzah casement 200 including an inscription 202 on a backing plate 204 that also includes a plurality of mounting holes 201 that are used to affix the mezuzah casement 200 to a doorpost of a building or a room. FIG. 2 also shows a mezuzah scroll 203 that may be encased (i.e., possibly back mounted) within the mezuzah casement 200. FIG. 3 shows in greater detail the mezuzah 203 in the form of a scroll upon which is written Hebrew text (i.e., typically the two paragraphs of Hebrew text from the Torah as described above).

Within the context of the embodiments, it is a challenge for parents and grandparents of the Jewish faith to pass on their love and appreciation of their Jewish religion and the Jewish religious values and traditions that it instills to their children. B'nai Mitzvah ceremonies are one source of passing along Jewish traditions. The work that is done by Jewish youth to achieve Torah reading ability and lead a congregation is easily forgotten, even though attempts are made to provide functional, symbolic and artful commemorative objects to the Jewish youth.

In view of the foregoing, there is a desire to provide a functional, and possibly symbolic and artful object to link the effort, knowledge, and work of the B'nai Mitzvah Jewish youth to meaningful remembrance and traditional Jewish practices throughout their lifetimes. In accordance with the embodiments, a particular approach to enable this desire is to provide a yad that is used for the reading of the Torah, perhaps only during a B'nai Mitzvah ceremony, that serves as at least a portion of a mezuzah casement that is mounted on the doorpost of a building or a room throughout one's lifetime, thus providing a new assembly of a yad and an integral mezuzah casement that may contain a mezuzah (i.e., a yad-mezuzah casement). Also considered within the context of the embodiments is a mounting bracket that may also be an integral component within the context of the foregoing yad-mezuzah casement. As noted above, in accordance with the embodiments a yad-mezuzah casement and a related bracket in accordance with the embodiments provides a yad-mezuzah casement kit.

In accordance with the foregoing discussion, the non-limiting embodiments provide a yad incorporating a mezuzah casement (i.e., a yad-mezuzah casement), as well as the foregoing yad-mezuzah casement kit.

Figure 4:
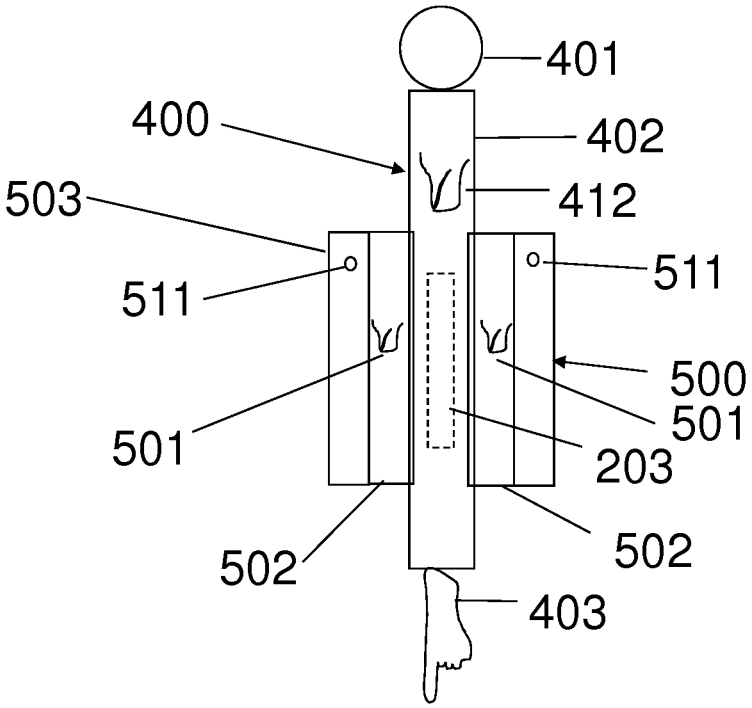
FIG. 4 shows a schematic diagram of a yad-mezuzah casement (i.e., a yad including a mezuzah casement) and a related mounting bracket in accordance with the embodiments.

A particular yad incorporating a particular mezuzah casement in accordance with the embodiments is illustrated within the schematic diagram of FIG. 4, which shows in addition to a yad 400 incorporating the mezuzah casement which encases a mezuzah 203, a mounting bracket 500 to thus provide the aforementioned yad-mezuzah casement kit. As will be discussed in further detail below, attachment means for attaching the yad-mezuzah casement 400 to a doorpost of a building or of a room in accordance with the embodiments are contained solely on the mounting bracket 500 (i.e., not on the yad-mezuzah casement 400) in a fashion that provides ease of assembly of the yad-mezuzah casement 400 to the doorpost of the building or the room, absent any compromise of use of the yad-mezuzah casement as a yad or a mezuzah casement.

In a first instance the yad-mezuzah casement 400 includes a central shaft portion 402 at a first end of which is located and assembled a decorative ball 401 and at a second end of which opposite the first end is located and assembled a pointer 403 which is fashioned in the likeness of a hand with a pointed finger. Thus, the yad-mezuzah casement 400 in accordance with the embodiments is otherwise generally similar with the yad 100 of FIG. 1, but within the yad-mezuzah casement 400 of FIG. 4, the mezuzah 203 is encased within a mezuzah casement that is at least in-part integral with the yad (i.e., at least a portion of the yad serves as a mezuzah casement). As is also illustrated within the schematic diagram of FIG. 4, the yad-mezuzah casement 400 also includes an inscription 412.

As is illustrated within the schematic diagram of FIG. 4, the mounting bracket 500 also includes an inscription 501, as well as attachment means 502 for assembling the yad-mezuzah casement 400 to the bracket 500, and holes 511 for mounting the mounting bracket 500 onto a doorpost of a building or a room.

While FIG. 4 illustrates the mezuzah 203 as contained within the central shaft portion of the yad-mezuzah casement 400 which may provide a weatherproof chamber for storage of the mezuzah 203 that may be accessible by removing the decorative ball, this particular embodiment, as well as the embodiments in general, are not intended to limit the invention. Rather, the embodiments also contemplate particular yad-mezuzah casement structures where a mezuzah may be contained within a mezuzah casement portion of the yad-mezuzah casement that is assembled to an outer (i.e., generally linear) portion of a central shaft portion of a yad, an inner portion of the central shaft portion of the yad and interposed between the central shaft portion of the yad and the mounting bracket (or doorpost). Other mezuzah casement locations of a yad-mezuzah casement of the embodiments are not precluded provided that these other mezuzah casement locations are consistent with the requirements described above with respect to the yad (i.e., at least a portion of which serves as a mezuzah casement).

Figure 5A:
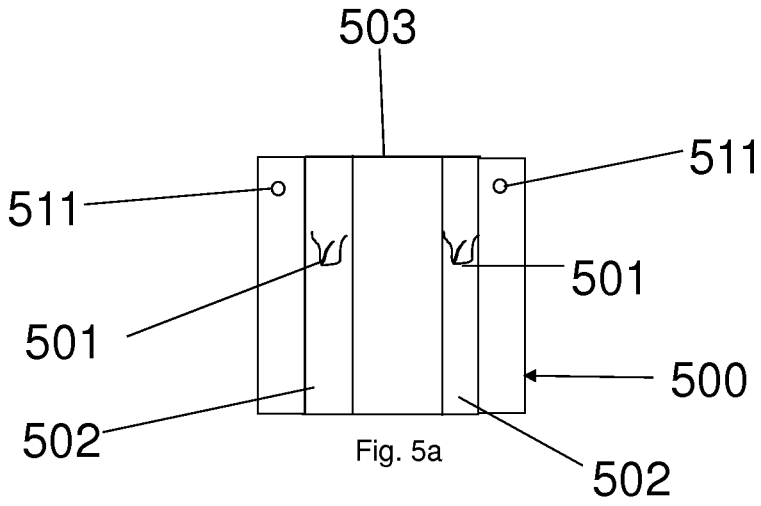
FIG. 5A and FIG. 5B show a front-view schematic diagram and an end-view schematic diagram of a first mounting bracket for the yad-mezuzah casement of the embodiments in accordance with FIG. 4.
Figure 5B:
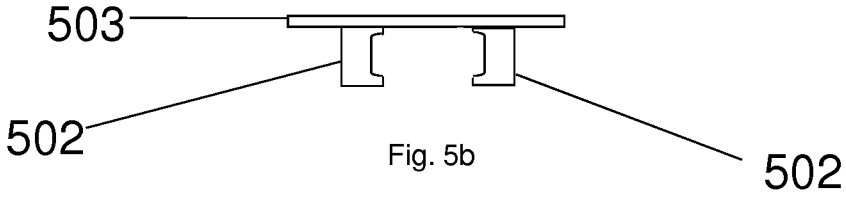
Figure 5C:
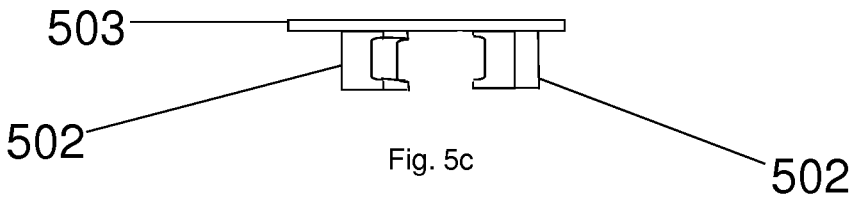
FIG. 5C and FIG. 5D shows an end-view schematic diagram and a front-view schematic diagram of a second mounting bracket for the yad-mezuzah casement of the embodiments in accordance with FIG. 4.
Figure 5D:
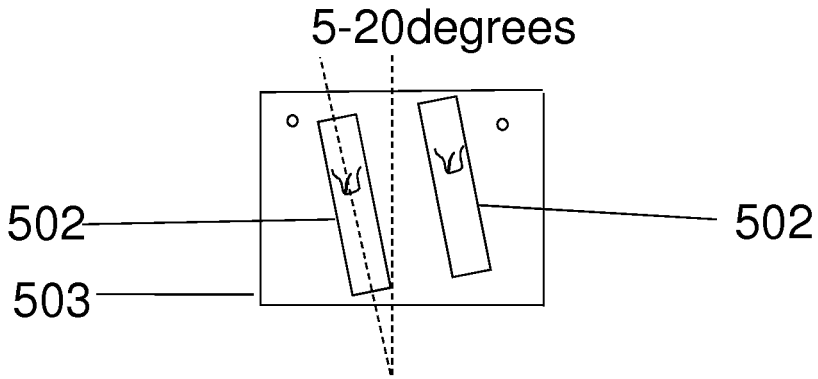

FIG. 5*a* and FIG. 5*b* show the mounting bracket 500 portion to which the yad-mezuzah casement 400 that is illustrated in FIG. 4 is mounted. FIG. 5*a* first shows a backing plate 503 to which is attached a plurality of attachment means 502. Also illustrated within the backing plate 503 are holes 511 for attaching the backing plate and the attachment means 502 to the doorpost of a building or a room. FIG. 5*c* and FIG. 5*d* show a cross-sectional view and a plan-view of a second embodiment of a mounting bracket for a yad-mezuzah casement in accordance with the embodiments. As is illustrated within FIG. 5*c* and FIG. 5*d*, the attachment means 502 that are otherwise similar with the attachment means 502 that are illustrated in FIG. 5*a* and FIG. 5*b*, but are offset by an amount from about 5 to about 20 degrees from a vertical component so that the yad-mezuzah casement that is assembled to the mounting bracket 500 which is attached to a doorpost of a building or a room may appropriately point upward and inward with respect to the building or room, as is common in Jewish tradition. Within FIG. 5A, FIG. 5B, FIG. 5C and FIG. 5D, the attachment means 502 may utilize any one or more of friction, mechanical stop, tying, clamping and permanent or semi-permanent adhesion means for securing a yad-mezuzah casement in accordance with the embodiments to the baseplate 503. As is noted above, the attachment means 502 are contained solely on the mounting bracket 500 and not on the yad-mezuzah casement 400.

A yad-mezuzah casement in accordance with the embodiments as described above thus expands a mezuzah casement which is often assembled to a doorpost of a building or a room to further include a yad that a Jewish youth may receive at a rites of passage ceremony related to Jewish cultural and theological training. By incorporating such a yad into a mezuzah casement to provide the yad-mezuzah casement in accordance with the embodiments, a Jewish youth is readily reminded of religious accomplishment and religious achievement insofar as the particular yad received by the Jewish youth having incorporated therein the mezuzah casement directly results from the religious ceremony and is visible daily mounted onto a doorpost of a building or of a room. Thus, the Jewish youth may interact with the yad-mezuzah casement their entire lives, following the tradition of touching the yad-mezuzah casement commemorative object and then putting their fingers to their lips.

Similarly, by including the attachment means of a yad-mezuzah casement 400 in accordance with the embodiments solely on the mounting bracket 500 for the yad-mezuzah casement 400 and not on the yad-mezuzah casement itself, functionality of the yad-mezuzah casement 400 as a yad is preserved.

Figure 6:
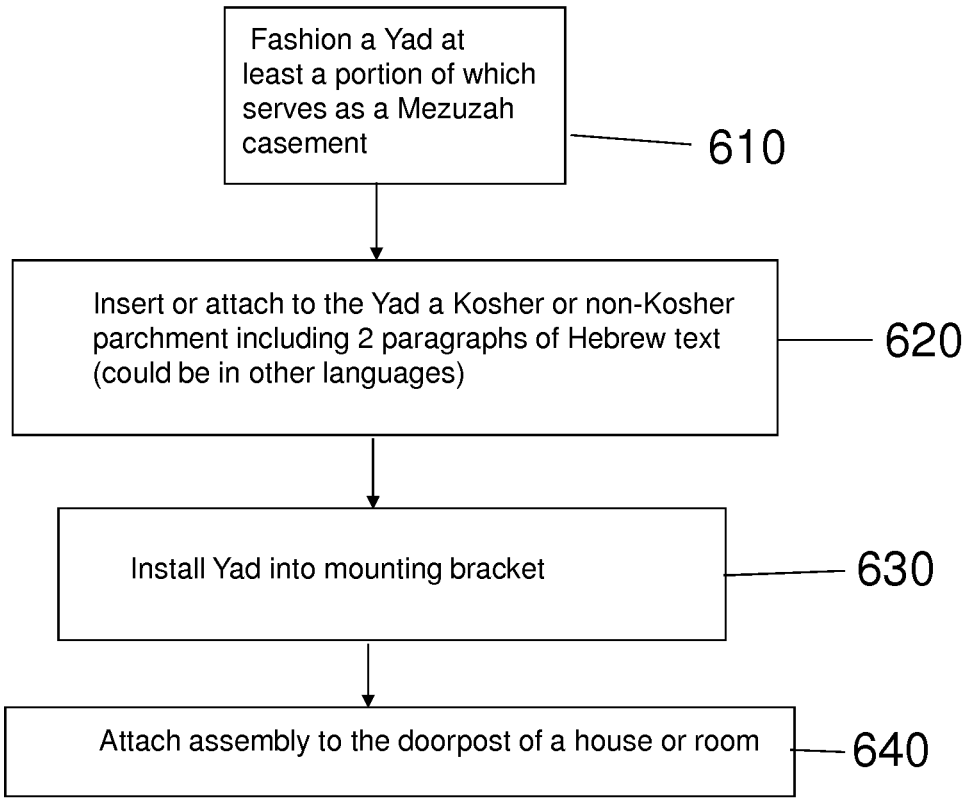
FIG. 6 shows a series of process steps that may be practiced in accordance with the embodiments to assemble a yad-mezuzah casement in accordance with the embodiments to the doorpost of a building or a room.

FIG. 6 shows a series of process steps that may be undertaken within the context of assembling a yad-mezuzah casement in accordance with the embodiments onto a doorpost of a building or of a room.

In accordance with process step 610, one first fashions a yad, at least a portion of which serves as a mezuzah casement. Such a yad may be otherwise generally conventional, and at the same time in accordance with description above have a portion of the yad adapted to a particular mezuzah scroll storage function (i.e., mezuzah casement) in accordance with the embodiments.

In accordance with process step 620, one inserts or attaches a Kosher or non-Kosher parchment with scripture (i.e., the 2 paragraphs from the Torah) written thereon into or onto the yad (i.e., yad-mezuzah casement) in accordance with the embodiments.

In accordance with process step 630 one next assembles the yad (i.e., yad-mezuzah casement) into a mounting bracket.

Finally in accordance with process step 640, one finally attaches the yad-mezuzah casement assembled into the mounting bracket onto the doorpost of a building or a room, in accordance with Jewish tradition.

As is understood by a person skilled in the art, and in accordance with further description below, the foregoing is a non-limiting order of process steps.

The following are some characteristics that may be considered within the context of a yad-mezuzah casement in accordance with the embodiments. Particularly, a yad-mezuzah casement in accordance with the embodiments provides that a yad that may be used in a B'nai Mitzvah ceremony can be provided with the parchment or scroll containing sacred writings within an integral mezuzah casement component (after its use as a pointer) and affixed to the doorpost of a building or a room.

Within the context of the embodiments a yad-mezuzah casement may be made of a variety of materials and decorated as desired. The parchment or scroll that may be contained within the yad-mezuzah casement may be a traditional Kosher document scribed by appropriate authorities, or alternatively sometimes used may be paper printed with the appropriate portion of the Torah. The parchment that comprises a mezuzah may be placed inside of the yad or attached to it in other manners. As noted above, these particular attachments include being held between the yad and a doorpost or being attached to the outer portion of the yad in an artistic manner.

A yad may be converted into a yad-mezuzah casement or a yad-mezuzah casement kit in accordance with the embodiments by providing a mounting fixture or bracket to attach the yad to a doorpost. This mounting fixture or bracket may be a complementary material and style of the yad so that the integrated components become one. Alternatively, the mounting components may be of other materials and styles that can be a simple as a fastener to as fancy as an engraved or otherwise documented fixture of the B'nai Mitzvah's ceremony.

In a particular embodiments the yad-mezuzah casement has the parchment or paper inside or attached while still functioning as a yad. In other particular embodiments the yad is fitted with a parchment or paper and mounted to a doorpost of a building or of a room. In yet other particular embodiments, the mounting fixture is oriented to hold the yad-mezuzah casement at a slight angle, with the top facing inwards to the doorway, when the mounting fixture is mounted vertically. This makes it easy for a person to mount the yad-mezuzah casement as prescribed by tradition by merely setting the mounting fixture square to the doorway. The prescribed angle is between 5 and 20 degrees from vertical.

In embodiments the yad is fitted with a parchment or paper and is mounted to a mating fixture, and the components form a yad-mezuzah casement. In embodiments the yad-mezuzah casement components are made a hand blown glass, mechanically formed glass or plastic, silver, gold, metal, ceramic, stone, wood, paper or beads. In embodiments the size of the yad within the yad-mezuzah casement is between about 3 and 9 inches in length, about ¼-3 inches in diameter or width and thickness. The yad-mezuzah casement may have a removable and re-sealable cap to protect the parchment or paper once it is inserted into the yad-mezuzah casement. In embodiments the yad-mezuzah casement has a hand or finger at the tip of the pointer.

All references, including publications, patent applications, and patents cited herein are hereby incorporated by reference in their entireties to the same extent as if each reference was individually and specifically indicated to be incorporated by reference and was set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening.

The recitation of ranges of values herein is merely intended to serve as a shorthand method of referring individually to each separate value falling within the range, unless otherwise indicated herein, and each separate value is incorporated into the specification as if it was individually recited herein.

All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not impose a limitation on the scope of the invention unless otherwise claimed.

No language in the specification should be construed as indicating any non-claimed element as essential to the practice of the invention.

It will be apparent to those skilled in the art that various modifications and variations can be made to the present invention without departing from the spirit and scope of the invention.

There is no intention to limit the invention to the specific form or forms disclosed, but on the contrary, the intention is to cover all modifications, alternative constructions, and equivalents falling within the spirit and scope of the invention, as defined in the appended claims. Thus, it is intended that the present invention cover the modifications and variations of this invention provided they come within the scope of the appended claims and their equivalents.

Therefore, the embodiments are illustrative of the invention rather than limiting of the invention. Revisions and modifications may be made to methods, materials structures and dimensions of a yad-mezuzah casement and a yad-mezuzah casement kit in accordance with the embodiments, while providing a yad-mezuzah casement and a yad-mezuzah casement kit in accordance with the invention, further in accordance with the accompanying claims.

What is claimed is:

1. A yad-mezuzah casement comprising:

a yad component including a shaft component terminating at one end with a pointer; and a mezuzah casement component that includes a hollow chamber within at least a portion of the shaft component of the yad component, the yad-mezuzah casement absent attachment means for attaching the yad-mezuzah casement to a doorpost.

2. The yad-mezuzah casement of claim 1 further comprising a mounting bracket including attachment means for attaching the yad-mezuzah casement to a doorpost.

3. The yad-mezuzah casement of claim 2 wherein the attachment means position the yad-mezuzah casement linearly with respect to a baseplate of the mounting bracket.

4. The yad-mezuzah casement of claim 2 wherein the attachment means position the yad-mezuzah casement at an offset angle from 5 to 20 degrees with respect to a baseplate of the mounting bracket.

5. The yad-mezuzah casement of claim 2 wherein the mounting bracket uses at least one of friction, mechanical stop, tying, clamping and permanent or semi-permanent adhesion means for securing the yad-mezuzah casement to the mounting bracket.

6. The yad-mezuzah casement of claim 1 wherein the hollow chamber comprises a weatherproof chamber that includes at least the portion of the shaft component of the yad component.

7. The yad-mezuzah casement of claim 1 wherein the yad-mezuzah casement is fabricated from a material selected from the group consisting of glass, plastic, silver, gold, metal, ceramic, stone, wood, paper and beads.

8. The yad-mezuzah casement of claim 1 further comprising a mezuzah located within the mezuzah casement component of the yad-mezuzah casement.

9. The yad-mezuzah casement of claim 1 wherein the yad component includes dimensions between 3 to 9 inches in length and ¼ to 3 inches in diameter.

10. The yad-mezuzah casement of claim 1 wherein the yad is fashioned in a likeness of a hand with a pointed finger.

11. A yad-mezuzah casement kit comprising:

a yad-mezuzah casement comprising:

a yad component including a shaft component terminating at one end with a pointer; and a mezuzah casement component that includes a hollow chamber within at least a portion of the shaft component of the yad component, the yad-mezuzah casement absent attachment means for attaching the yad-mezuzah casement to a doorpost; and a mounting bracket including attachment means for attaching the yad-mezuzah casement to a doorpost, wherein the attachment means position the yad-mezuzah casement linearly with respect to a baseplate of the mounting bracket.

12. The yad-mezuzah casement kit of claim 11 wherein the hollow chamber comprises a weatherproof chamber that includes at least the portion of the shaft component of the yad component.

13. The yad-mezuzah casement kit of claim 11 wherein the yad is fashioned in a likeness of a hand with a pointed finger.

14. A yad-mezuzah casement kit comprising:

a yad-mezuzah casement comprising:

a yad component including a shaft component terminating at one end with a pointer; and a mezuzah casement component that includes a hollow chamber within at least a portion of the shaft component of the yad component, the yad-mezuzah casement absent attachment means for attaching the yad-mezuzah casement to a doorpost; and a mounting bracket including attachment means for attaching the yad-mezuzah casement to a doorpost, wherein the attachment means position the yad-mezuzah casement offset with respect to a baseplate of the mounting bracket.

15. The yad-mezuzah casement kit of claim 14 wherein the hollow chamber comprises a weatherproof chamber that includes at least the portion of the shaft component of the yad component.

16. The yad-mezuzah casement kit of claim 14 wherein the yad is fashioned in a likeness of a hand with a pointed finger.

* * * * *